US012714926B2

(12) United States Patent
Han

(10) Patent No.: US 12,714,926 B2
(45) Date of Patent: Aug. 25, 2026

(54) GOLF PUTTING APPARATUS AND BOARD GAME

(71) Applicant: Jaeson Han, Dresher, PA (US)

(72) Inventor: Jaeson Han, Dresher, PA (US)

( * ) Notice: Subject to any disclaimer, the term of this patent is extended or adjusted under 35 U.S.C. 154(b) by 351 days.

(21) Appl. No.: 18/597,774

(22) Filed: Mar. 6, 2024

(65) Prior Publication Data

US 2025/0281809 A1 Sep. 11, 2025

(51) Int. Cl.

| | |
|---|---|
| ***A63B 67/02*** | (2006.01) |
| ***A63B 69/36*** | (2006.01) |
| ***A63B 71/06*** | (2006.01) |

(52) U.S. Cl.

CPC ..... *A63B 67/02* (2013.01); *A63B 69/3676* (2013.01); *A63B 71/0605* (2013.01); *A63B 2071/0694* (2013.01); *A63B 2214/00* (2020.08); *A63B 2225/74* (2020.08)

(58) Field of Classification Search

CPC . A63B 67/02; A63B 69/3676; A63B 71/0605; A63B 2071/0694; A63B 2214/00; A63B 2225/74; A63B 63/00; A63B 2220/805; A63B 71/0622; A63F 2003/0041; A63F 2003/00637; A63F 2003/00798; A63F 2009/2442; A63F 2009/2452; A63F 3/00094; A63F 9/001

See application file for complete search history.

(56) References Cited

U.S. PATENT DOCUMENTS

| | | | | |
|---|---|---|---|---|
| 7,810,814 | B1 * | 10/2010 | Chapman | A63F 3/00094 273/287 |
| 2006/0175755 | A1 * | 8/2006 | Milner, III | A63F 3/0423 273/271 |
| 2014/0159309 | A1 * | 6/2014 | Jiang | A63F 3/00634 273/271 |
| 2021/0093945 | A1 * | 4/2021 | Shoaff | A63F 9/0252 |
| 2023/0211229 | A1 * | 7/2023 | Rigby | A63F 3/00533 273/271 |

* cited by examiner

*Primary Examiner* — Jeffrey S Vanderveen
(74) *Attorney, Agent, or Firm* — Eugene Kim

(57) ABSTRACT

An apparatus for practicing golf putting while playing Connect Four. The Connect Four game board is positioned in an upright vertical orientation with horizontally spaced openings directly underneath through which putted golf balls can pass. Sensors detect the passage of putted golf balls and cause lights to turn on in the game board. Each light that turns on is analogous to the placement of a chip in the traditional Connect Four game board. The apparatus is suited for indoor or outdoor use on a variety of playing surfaces allowing for putting from varied distances, slopes, and angles.

2 Claims, 3 Drawing Sheets

GOLF PUTTING APPARATUS AND BOARD GAME

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A LARGE TABLE, OR A COMPUTER PROGRAM LISTING APPENDIX ON READ-ONLY OPTICAL DISC

Not Applicable

BACKGROUND OF THE INVENTION

The present invention generally relates to the sport of golf. More particularly, the present invention relates to an apparatus for practicing golf putting.

Apparatuses for practicing golf putting in a competitive game setting have long been in existence. One configuration of such an apparatus includes a means for receiving a putted golf ball, arrangement of the receiving means to allow for competitive game play, sensors for detecting the golf ball, and a system for displaying an output based on input received by the sensor. Apparatuses configured in this way, however, have certain limitations. At least some of them are difficult to store, transport, or set up due to their size and bulk. Some may be suited more for indoor use than outdoor use or vice versa. Some, while offering helpful ways to practice golf putting, are not particularly fun as games. Conversely, some offer game play that is enjoyable but at the cost of their utility for putting practice.

U.S. Pat. No. 4,327,917 discloses a golf putting game that utilizes horizontally spaced sensors positioned lengthwise of an opening in a housing that has a numerical display for indicating a game score. The size of the housing appears to render it impractical for easy storage, transport, or set up, particularly in a home setting.

U.S. Pat. No. 4,761,009 discloses a golf putting game device that has a housing with slots for receiving golf balls and a means for switching on lights corresponding to the accuracy with which the ball was putted. While the device can be used for practicing golf putting, it does not provide a truly enjoyable or competitive game.

U.S. Pat. No. 5,181,721 discloses a golf game apparatus with rotatable targets and a means for displaying game-related data or output. While apparatus is styled as a game, it does not provide the ability to play a game whose rules are independent of golf putting.

U.S. Pat. No. 6,602,146 discloses a putting skill game with lever-based ball sensors and a system of light detection. Similar to other prior art, this invention does not provide the ability to play a game whose rules are independent of golf putting.

A YouTube video entitled "GOLF CONNECT 4=BEST GAME EVER!!" and available at https://youtu.be/JAwHzWJWkVc discloses a self-contained mini golf apparatus for playing Connect Four. Due to its size, the apparatus is not practical for storage in many home settings and is not capable of easy transport or set up.

A blog article entitled "Connect Fore!" on Bithead's Blog and available at https://bithead942.wordpress.com/2021/04/25/connect-fore/discloses another self-contained mini golf apparatus for playing Connect Four. Due to its size, the apparatus is not practical for storage in many home settings and is not capable of easy transport or set up.

BRIEF SUMMARY OF THE INVENTION

The present invention is directed to an apparatus that can be used as a tool for improving the participant's golf putting skills while at the same time playing the popular board game Connect Four with another participant. Other games can be played provided such games can utilize the Connect Four game board. The present invention is also directed to a method of playing Connect Four using the apparatus.

In accordance with one aspect of the invention, the apparatus has a Connect Four game board positioned on top of a base with openings allowing for the passage of putted golf balls. Each of the circular spaces that a game chip would occupy in the traditional Connect Four game board contains a colored light in the apparatus of the present invention. Sensors detect the passage of golf balls through each of the openings in the base. When triggered, the sensor causes a light to turn on in the column above the opening through which the putted golf ball passed. Participants can play the board game known as Connect Four using the apparatus.

The present invention can be used indoors or outdoors and on a variety of playing surfaces, making it more versatile and useful than many existing apparatuses for golf putting training. It is also easier to store, transport, and set up than many existing golf putting apparatuses. Because the apparatus incorporates the playing surface of the surrounding environment, the distance from which participants can practice putting is limited only by the environment in which they use the invention.

DETAILED DESCRIPTION OF THE INVENTION

Figure 1:
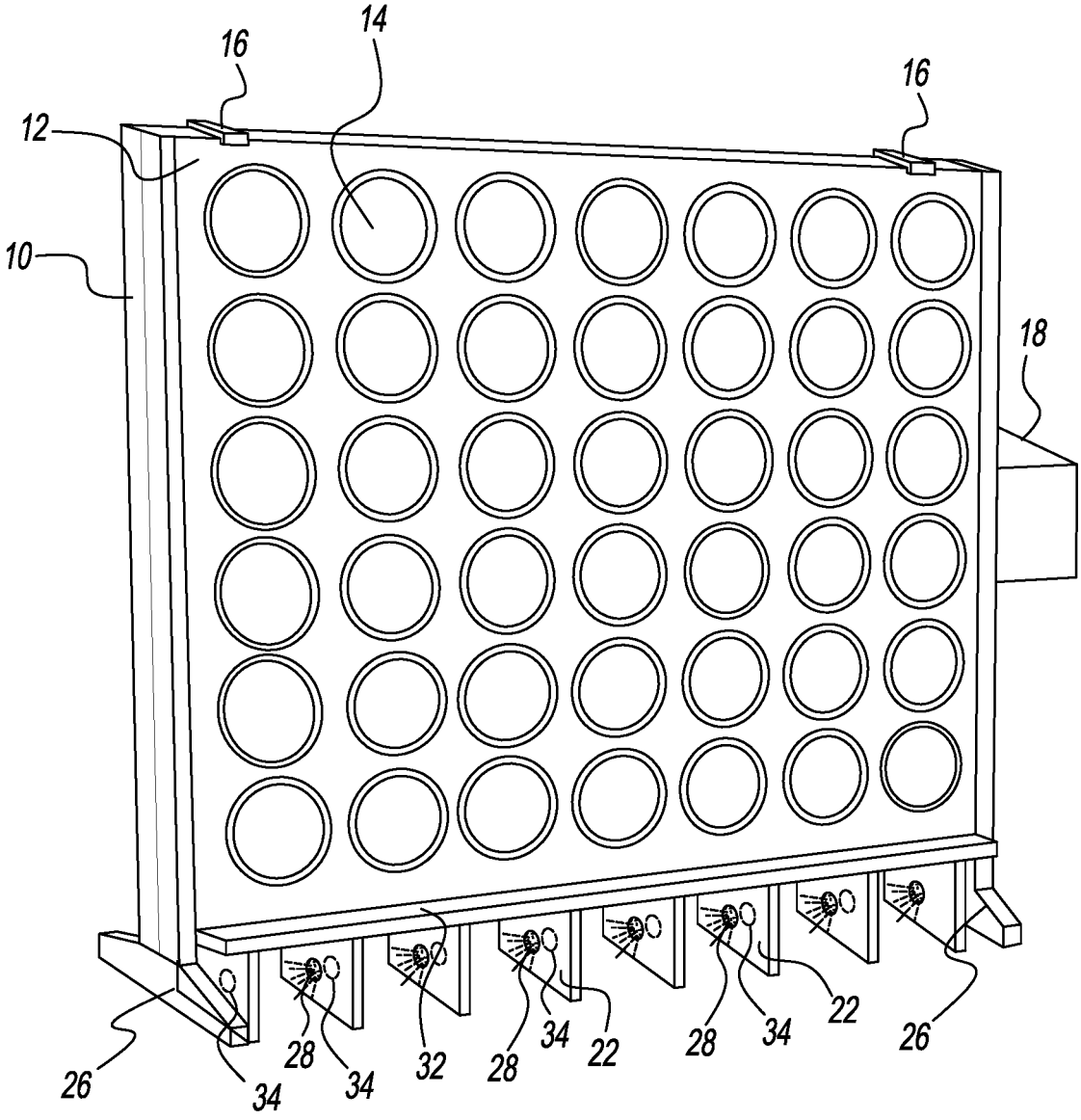
FIG. 1 is a perspective view of the present invention.

With reference to the drawings, and in particular to FIG. 1, an apparatus incorporating the concepts of the present invention will be described.

The apparatus 10 of the present invention comprises a vertically oriented game board 12 with means for keeping the game board upright and stable. In one embodiment of the invention, the said means for keeping the game board 12 upright are feet structures 26 located at both ends of the bottom of the game board 12. The game board 12 has a total of forty-two circular slots 14 arranged in six rows and seven columns. The game board 12 can be made from wood, plastic, or any other suitable material.

Figure 2:
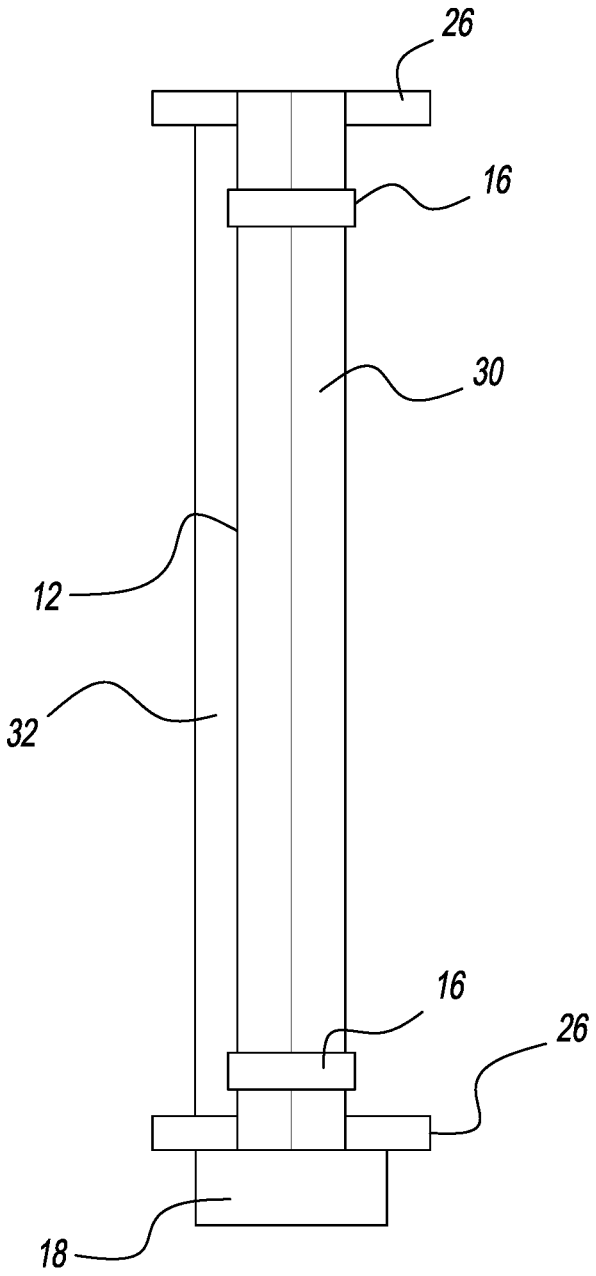
FIG. 2 is a top view of the present invention.
Figure 3:
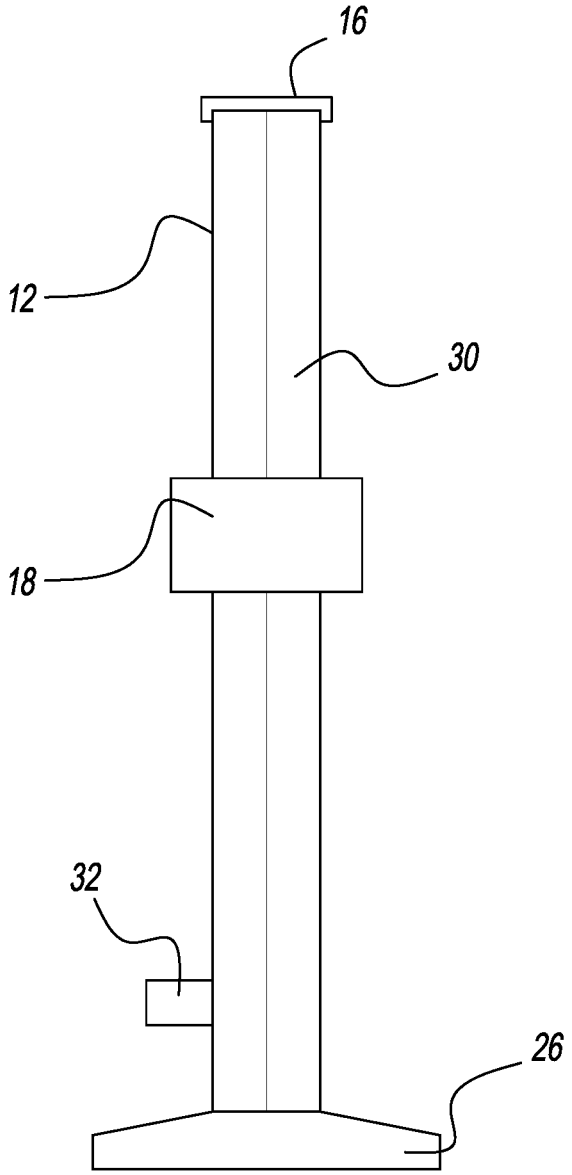
FIG. 3 is a side view of the present invention.

Each of the slots 14 includes a means for illumination. Each slot 14 may have an external covering, such as, for example, a translucent dome that fits over the slot 14, to enhance the lighting effect or for aesthetic appeal. In one embodiment of the invention, an LED light is the means for illuminating each slot 14. With reference to FIGS. 2 and 3, each of said LED lights are attached to a fixed spot on the panel 30. Each such affixed LED light corresponds to a particular slot 14. The panel 30, which can be a foam board or a board made from other suitable material, is affixed to the game board 12 in such manner that the game board 12 is superimposed on the panel 30. When the apparatus 10 is viewed from the front, as shown in FIG. 1 for example, the panel 30 is not visible. The game board 12 and the panel 30 may be affixed by means of a clip 16 or, alternatively, with an adhesive or other suitable means.

As shown in FIG. 1, the apparatus 10 includes seven horizontally spaced openings below the game board 12 through which putted golf balls can pass through. Each of the said openings is located directly underneath one of the seven columns of slots 14. In one embodiment of the invention, said openings are created using a horizontal element 32 that is positioned directly underneath the game board 12 and runs lengthwise from one side of the game board 12 to the other side. Eight dividing means 22 are positioned underneath and perpendicular to the horizontal element 20 and in between the feet 26 to create seven horizontally spaced openings of equal size.

Each of the seven horizontally spaced openings has a means for detecting the passage of a golf ball through said opening and a means for causing the illumination of each slot 14. In one embodiment of the invention, each opening has a corresponding light dependent resistor ("LDR") circuit, including a dedicated light source 28 and a sensor 34 for detecting said light. Each LDR circuit is connected to a printed circuit board ("PCB") that is contained in housing 18. When the ball passes through an opening, the light emanating from source 28 will be momentarily deflected by the passing ball causing a change in the light intensity that falls on the LDR. The PCB detects the resulting drop in voltage, which causes a light to turn on in one of the slots 14 in the column directly above the opening through which the ball passed.

The PCB can be an Arduino, Raspberry Pi, or similar product, or a custom manufactured PCB. The housing 18 includes a power source, such as a battery, or a means to connect to a power source, such as a plug that connects to an outlet. The housing 18 may have one or more buttons which interact with the PCB and can be used for various functions, such as changing from one player to another or for changing the "mode" of the apparatus (e.g., game mode, practice mode, light show mode, etc.).

The apparatus 10 may also utilize other means to detect the passage of a golf ball through the horizontally spaced openings, such as, for example, a physical switch.

In the preferred embodiment of the invention, it is envisioned that two participants will practice their golf putting skills while playing Connect Four. In the game of Connect Four, two players take turns inserting colored chips into a game board having a vertical orientation and configured with six rows and seven columns of chip-receiving slots. Each chip, which is placed into a specific column from the top of the board, falls down the column to the bottommost unoccupied space. The player who first arranges his or her chips in a line of four consecutive chips, whether horizontal, vertical, or diagonal, is the winner. Connect Four, adapted to the present invention, can be played by putting golf balls through the openings corresponding to the columns of the game board. At the start of the game, none of the slots 14 are illuminated. As the participants putt the golf ball through the openings, the corresponding circular slot 14 becomes illuminated, starting from the bottom and going in ascending order. Ideally, the slots 14 can be illuminated in at least two different colors to distinguish which slots 14 belong to which player. The first participant who lights up four slots 14 in a row is the winner.

Some aspects of playing Connect Four with the present invention may be variable. For example, participants must determine the rules concerning the location from where they will putt the golf ball. In one version of the game, the participants utilize a die, or other means of randomly generating a number, during each turn. Each number that can be generated corresponds to a different predetermined putting location. In another version of the game, the participants will choose one location and make all their putts from that location. The participants may employ any number of other rules for determining putting location.

As the playing surface is not contained within the apparatus itself, the distance from which the participants putt the ball is limited only by the environment surrounding the apparatus. Similarly, participants may putt the ball from any number of different angles and may putt the ball on an incline, decline, or flat surface. Furthermore, the apparatus can be used indoors or outdoors. The feet 26 can be modified to adapt the apparatus for uneven playing surfaces.

Because of the golf putting dimension to using the apparatus, there are many variations that can be made to the traditional rules of Connect Four. For example, if a participant fails to putt the golf ball through an opening (e.g., because the ball hits a divider 22), the rule can be that the participant loses his or her turn, or that he or she loses a lighted slot 14. Furthermore, the apparatus can be used for games or activities other than Connect Four so long as any such game or activity can be used with a Connect Four board.

What is claimed is:

1. An apparatus including:

A vertically oriented game board having 42 circular slots arranged in seven columns and six rows, wherein said game board includes structural means for keeping said game board in a stable upright position, wherein each of said circular slots includes means for illumination;

a plurality of dividing means positioned underneath said game board such that there are seven horizontally spaced openings corresponding to each of said seven columns of circular slots;

a detecting means to determine when a golf ball has passed through each of said horizontally spaced openings; and a means for turning on the said means of illumination in each circular slot based on detection of passage of a golf ball through said horizontally spaced openings.

2. A method of playing a board game providing for competitive play between two players and golf putting practice for both players, said method including:

providing the apparatus according to claim 1;

choosing a distance or distances from which to putt golf balls toward said apparatus;

the players taking turns putting a golf ball toward said apparatus;

illumination of a circular slot in the game board column of said apparatus upon passage of a golf ball through a horizontally spaced opening of said apparatus, wherein the circular slot that becomes illuminated is the circular slot that is the bottommost previously unilluminated slot in the column corresponding to the horizontally spaced opening through which said golf ball passed; and the winner being the player who causes four consecutive circular slots, whether in a horizontal, vertical, or diagonal line, to illuminate.

* * * * *